United States Patent [19]

Illustrato

[11] Patent Number: 4,894,934

[45] Date of Patent: Jan. 23, 1990

[54] REBOUND HEEL DEVICE

[76] Inventor: Vito J. Illustrato, 928 Peace St., Pelham Manor, N.Y. 10803

[21] Appl. No.: 300,309

[22] Filed: Jan. 23, 1989

[51] Int. Cl.[4] ..... A43B 21/26; A43B 21/32

[52] U.S. Cl. ..... 36/037; 36/38; 36/102

[58] Field of Search ..... 36/7.8, 27, 28, 29, 36/35 R, 37, 38, 83, 102, 103, 105

[56] References Cited

U.S. PATENT DOCUMENTS

| | | | |
|---|---|---|---|
| 1,172,613 | 2/1916 | Larsen | 36/37 |
| 1,332,070 | 2/1920 | Shamo | 36/37 |
| 1,399,153 | 12/1921 | Rogers | 36/37 |
| 1,746,069 | 2/1930 | Butzen | 36/37 |
| 2,632,964 | 3/1953 | Kriegel | 36/37 |
| 2,814,132 | 11/1957 | Montoscuro | 36/37 |
| 2,967,362 | 1/1961 | Montoscuro | 36/37 |
| 3,205,596 | 9/1965 | Hoffmeister | 36/7.8 |
| 4,196,903 | 4/1980 | Illustrato | 36/7.8 X |
| 4,638,575 | 1/1987 | Illustrato | 36/37 |
| 4,756,095 | 7/1988 | Lakic | 36/37 X |

*Primary Examiner*—Donald Watkins

*Attorney, Agent, or Firm*—Richard L. Miller

[57] ABSTRACT

This heel device is designed to cause a heel portion of a shoe to rebound when a person walks or jogs. Primarily, it consists of a base plate secured to the bottom of the heel portion of the shoe, and a leaf hinge is secured to the base plate and pivots. Projections are secured to the leaves of the hinge and include a pair of shafts that retain and support an endless rubber belt that provides the tension for the shoe to rebound.

4 Claims, 1 Drawing Sheet

REBOUND HEEL DEVICE

BACKGROUND OF THE INVENTION

The instant invention relates generally to footwear, and more particularly, to a rebound heel device.

Numerous devices have been provided in the prior art that are adapted to enable a wearer to bounce while walking, jogging, etc. For example, U.S. Pat. Nos. 4,638,575 of Illustrato, and 4,196,903 of Illustrato, both are illustrative of such prior art. While these units may be suitable for the particular purpose to which they address, they would not be as suitable for the purpose of the present invention as hereafter described.

SUMMARY OF THE INVENTION

A primary object of the present invention is to provide a rebound heel device that will overcome the shortcomings of the prior art devices.

Another object is to provide a rebound heel device that will be of such design as to enable a user to bounce through the employment of a special hinge secured in the bottom of a heel of a shoe.

An additional object is to provide a rebound heel device that will employ the use of an endless belt of rubber for its operation.

Yet another object is to provide a spring heel which could be incorporated into work shoes, dress shoes or sport shoes of various sizes.

A further object is to provide a rebound heel device that is simple and easy to use.

A still further object is to provide a rebound heel device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
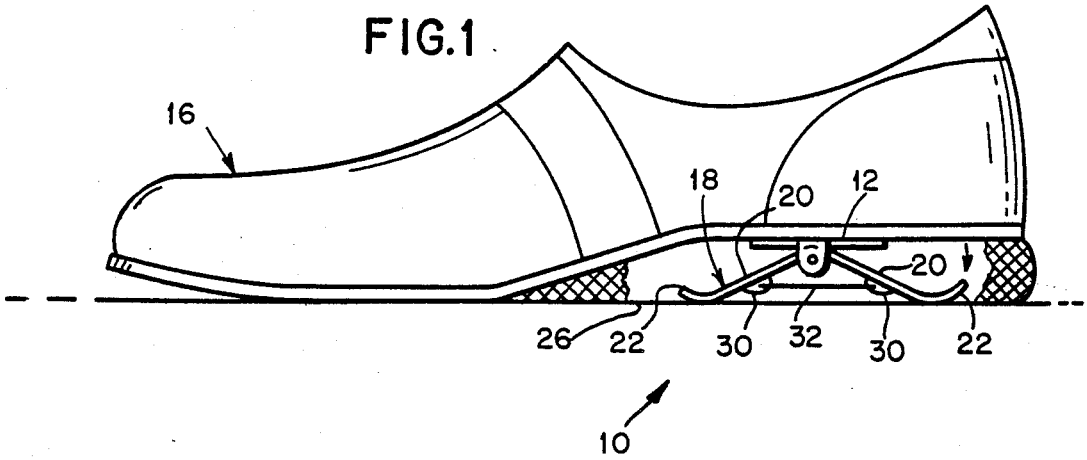
FIG. 1 is a diagrammatic side view of the instant invention.
Figure 2:
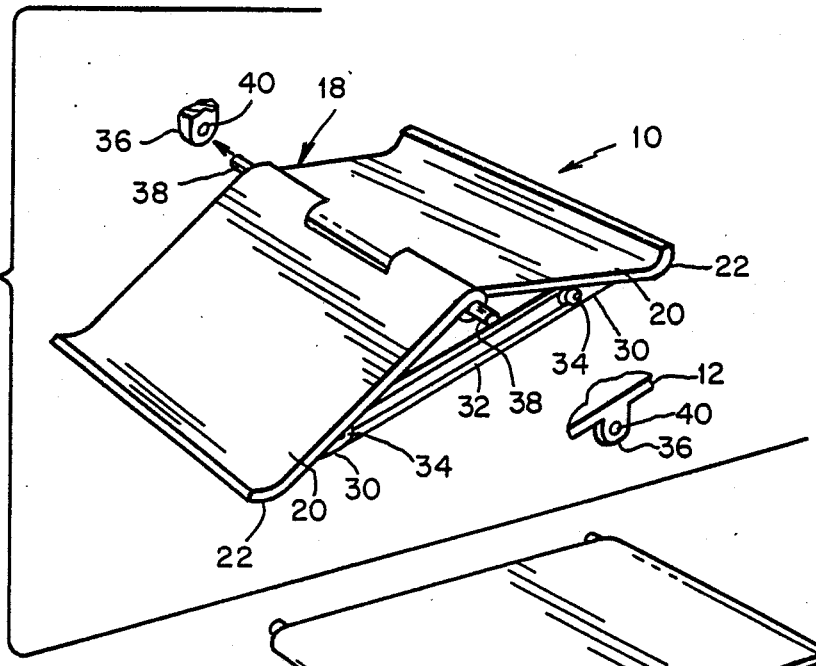
FIG. 2 is a perspective view of the rebound mechanism shown removed from its mounting plate.
Figure 3:
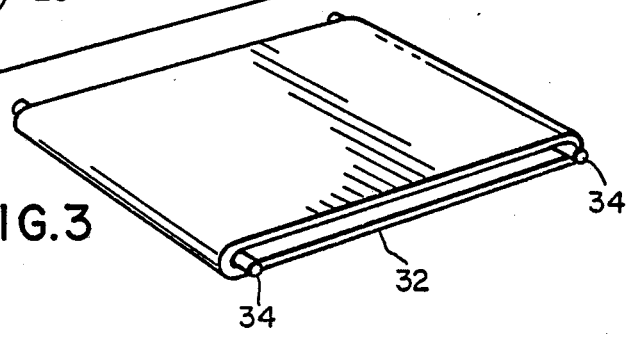
FIG. 3 is a perspective view of the stretching member shown removed therefrom.
Figure 4:
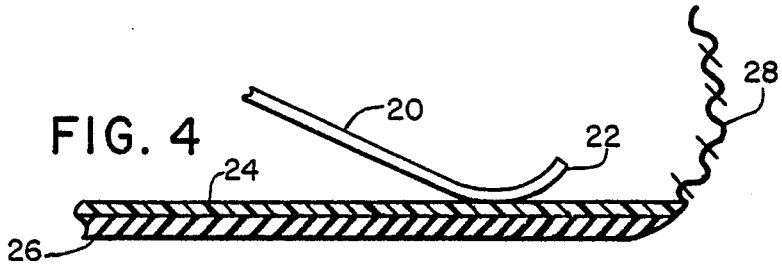
FIG. 4 is an enlarged fragmentary side elevational view of the invention shown partly broken away.

Turning now descriptively to the drawings, in which like reference characters denote like elements throughout the several views, a heel device 10 is shown to include a flat base plate 12 that is fixedly secured to a bottom heel portion 14 of a shoe 16. A pivotal leaf hinge 18 is provided and pivotally secured at a center portion to base plate 12, by its pivot shaft 38 which extends through journal holes 40 in each of two ears 36 which are integrally attached to plate 12, as best seen in FIGS. 1 and 2. This assembly includes a pair of leaves 20 with curved ends 22 that enables skidding and non-digging on an anti-friction material 24 typically polytetrafluoroethylene fixedly secured to a bottom member 26 fixedly secured to shoe 16, as best seen in FIG. 4.

A porous canvas member 28 is provided and is fixedly secured to bottom member 26 and side portions of shoe 16, for providing air escape and air entry into the area of the rebound mechanism, for effective operation thereof. Canvas member 28 also provides covering of the area of the rebound mechanism and enhances the decorative appearance of the shoe 16 as well.

In use, each time the weight of a wearer comes down on the heel portion 14, it causes the leaves 20 of hinge 18 to pivot towards the heel portion 14 against the tension of the endless belt 32. When the heel portion 14 is again elevated by contraction of endless rubber belt 32, a rebound or bounce is effected by the leaves 20 pivoting towards each other.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A rebound heel device for a shoe which comprises:

a. a base plate, for securement to a heel portion of said shoe;

b. a pivotal leaf hinge secured to said base plate, for engagement with an anti-friction material c. a bottom heel member having said anti-frictional material secured thereto;

d. an endless rubber belt secured to said pivotal leaf hinge, for providing tension means for a pair of leaves of said leaf hinge that causes a rebound of said heel portion of said shoe; and e. a canvas member secured to said shoe, providing protective covering and ventilation means for said rebound heel device.

2. A rebound heel device as set forth in claim 1, wherein said base plate is fixedly secured to a bottom surface of said heel portion of said shoe and a center portion of said hinge is pivotally secured to said base plate and curved ends of said pair of leaves of said hinge slideably engage with said anti-friction material that is fixedly secured to said bottom member of said shoe, and a forward portion of said bottom member is fixedly secured to a sole portion of said shoe and provides for engagement with a ground surface.

3. A rebound heel device as set forth in claim 2, wherein a pair of projections are fixedly secured to side portions of said pair of leaves and shafts are secured in said projections and support ends of said endless rubber belt that cooperates with said pair of leaves and provides said tension means that initiates said rebound of said heel portion of said shoe, and said pair of leaves pivotally elevate and lower while remaining in sliding engagement with said anti-friction material.

4. A rebound heel device as set forth in claim 3, wherein said ventilation means for said rebound heel device comprises said canvas member that is fixedly secured to said bottom member and side portions of said shoe, and said canvas member is porous and allows air escape and entry into said heel portion for effective operation and covering protection for said heel device.

* * * * *